US006875509B2

(12) United States Patent
Ando

(10) Patent No.: US 6,875,509 B2
(45) Date of Patent: Apr. 5, 2005

(54) FIBER FOR REINFORCING RUBBER PRODUCTS

(75) Inventor: Kimihiro Ando, Tokyo (JP)

(73) Assignee: Asahi Fiber Glass Company, Limited, Tokyo (JP)

( * ) Notice: Subject to any disclaimer, the term of this patent is extended or adjusted under 35 U.S.C. 154(b) by 0 days.

(21) Appl. No.: 10/867,682

(22) Filed: Jun. 16, 2004

(65) Prior Publication Data

US 2005/0003186 A1 Jan. 6, 2005

(30) Foreign Application Priority Data

Jun. 18, 2003 (JP) ..... 2003-173085

(51) Int. Cl.[7] ..... D02G 3/00; B32B 9/00
(52) U.S. Cl. ..... 428/375; 428/392; 428/390
(58) Field of Search ..... 428/375, 390, 428/392, 388; 152/452

(56) References Cited

U.S. PATENT DOCUMENTS 4,239,800 A 12/1980 Girgis
5,154,975 A * 10/1992 Sekiguchi et al. ..... 428/388
5,236,742 A * 8/1993 Sekigushi et al. ..... 427/389.7

FOREIGN PATENT DOCUMENTS

| | | |
|---|---|---|
| EP | 0 306 883 A2 | 3/1989 |
| EP | 0 624 557 A1 | 11/1994 |
| JP | 63-126975 | 5/1988 |
| JP | 4-56053 | 9/1992 |
| JP | 5-311577 | 11/1993 |
| JP | 11-241275 | 9/1999 |

* cited by examiner

*Primary Examiner*—N. Edwards
(74) *Attorney, Agent, or Firm*—Oblon, Spivak, McClelland, Maier & Neustadt, P.C.

(57) ABSTRACT

Fiber for reinforcing rubber products, which comprises fiber coated with a coating film formed by a coating agent, wherein the coating agent comprises, as calculated as solid contents, 100 parts by mass of a rubber latex containing at least a vinylpyridine/styrene/butadiene terpolymer, from 7 to 18 parts by mass of a latex of a halogen-containing polymer, and from 2 to 10 parts by mass of a water-soluble condensate of resorcinol and formaldehyde.

4 Claims, 1 Drawing Sheet

FIBER FOR REINFORCING RUBBER PRODUCTS

Figure 1:
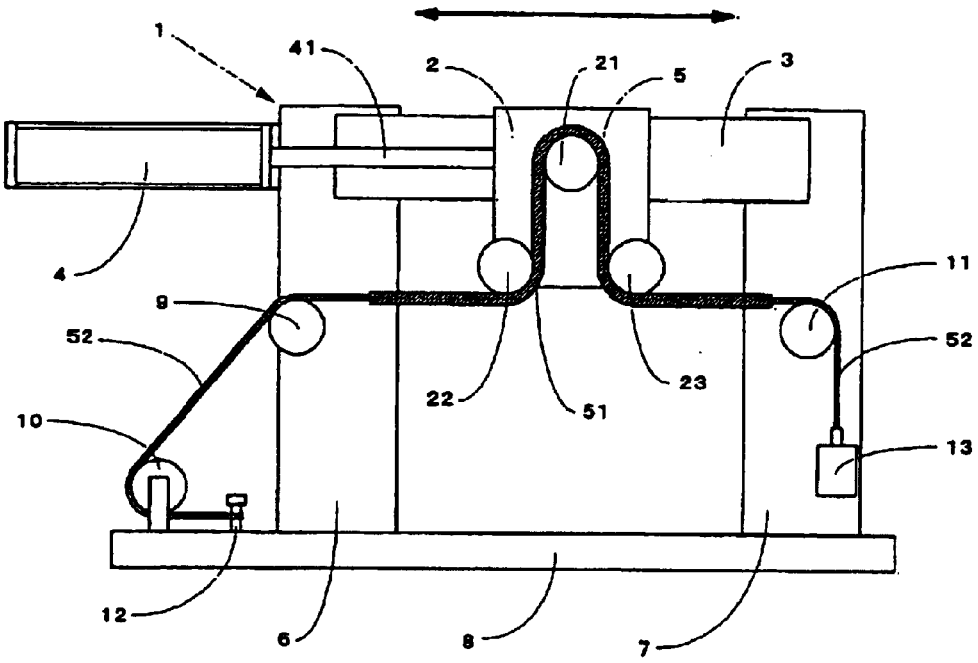

The present invention relates to fiber for reinforcing rubber products, which is used as a reinforcing material for various rubber products such as rubber tires or rubber belts including timing belts.

It is common that reinforcing fiber to be used to increase the strength or durability of various rubber products such as rubber tires or rubber belts including timing belts, is coated with a coating film formed by a rubber type treating agent in order to increase the adhesion between the fiber and a rubber base material in a rubber product and in order to increase the durability of the rubber product by protecting the fiber itself. As such a rubber type treating agent, a treating agent comprising a condensate of resorcinol and formaldehyde, and a rubber latex, as the main components (hereinafter sometimes referred to as "RFL treating agent"), is known.

Particularly, a driving belt such as a timing belt to be used for an automobile engine is required to have durability under a severe condition such as a high temperature. Accordingly, the rubber as its base material and the reinforcing fiber are required to have heat resistance. Accordingly, as a reinforcing fiber to be used for such a timing belt, fiber is known which is coated with a coating film formed by a RFL treating agent, having a highly heat resistant rubber latex, such as a halogen-containing polymer, incorporated.

For example, JP-B-4-56053 discloses a RFL treating agent which comprises, based on the total amount of the solid contents of the respective components, from 2 to 15 mass % of a resorcinol/formaldehyde resin, from 15 to 80 mass % of a butadiene/styrene/vinylpyridine terpolymer and from 15 to 70 mass % of a chlorosulfonated polyethylene.

Further, JP-A-5-311577 discloses a RFL treating agent which comprises, as the respective concentrations of contained components, from 10 to 30 mass % of a vinylpyridine/styrene/butadiene terpolymer latex, from 3 to 25 mass % of a chlorosulfonated polyethylene latex and from 0.5 to 6 mass % of a water-soluble condensate of resorcinol and formaldehyde.

However, the RFL treating agents disclosed in the above patent documents, have the following problems. A driving belt such as a timing belt to be used for an automobile engine is required to have durability against contact with water in addition to the durability at a high temperature. Therefore, the rubber as its base material and the reinforcing fiber are required to have water resistance.

The proportions as solid contents of the respective components contained in the RFL treating agent of JP-B-4-56053 are from 18.8 to 466.7 parts by mass of the chlorosulfonated polyethylene and from 2.5 to 100 parts by mass of the resorcinol/formaldehyde resin, per 100 parts by mass of the butadiene/styrene/vinylpyridine terpolymer.

Further, within such ranges, preferred proportions of the butadiene/styrene/vinylpyridine terpolymer and the chlorosulfonated polyethylene are, as disclosed in Examples 1 to 4, 44.4, 66.7, 130.4 and 66.7 parts by mass of the chlorosulfonated polyethylene, per 100 parts by mass of the butadiene/styrene/vinylpyridine terpolymer.

In the above-mentioned proportions, the heat resistance of the reinforcing fiber will be sufficiently satisfied, but the proportion of the butadiene/styrene/vinylpyridine terpolymer to the chlorosulfonated polyethylene is relatively small, whereby the water resistance of the reinforcing fiber tends to be inadequate, and the finally obtainable timing belt tends to have poor durability against contact with water. This is considered to be attributable to the fact that the tackiness (stickiness degree) of the reinforcing fiber tends to be low, whereby the adhesion degree of a plurality of glass fibers (first twist yarns) constituting the reinforcing fiber one another tends to be low, and thus water is likely to penetrate into the interior of the reinforcing fiber, and the penetrated water tends to accelerate deterioration of the reinforcing fiber.

On the other hand, with respect to the RFL treating agent of JP-A-5-311577, in Examples 1 and 2, it is disclosed that the chlorosulfonated polyethylene latex is 6 parts by mass per 100 parts by mass of the vinylpyridine/styrene/butadiene terpolymer latex, as calculated as solid contents.

However, with such proportions, the content of the chlorosulfonated polyethylene latex to provide heat resistance, is small, whereby heat resistance of the reinforcing fiber tends to be inadequate, and the finally obtainable timing belt will be poor in durability at a high temperature. Further, with the above-mentioned proportions, the content of the vinylpyridine/styrene/butadiene terpolymer latex is large, whereby the tackiness of the reinforcing fiber tends to be too high, whereby a trouble may thereby be caused during the production.

Accordingly, the present invention has been made to solve such problems of the prior art, and it is an object of the present invention to provide fiber for reinforcing rubber products, which has both heat resistance and water resistance and which is suitable for a timing belt for an automobile engine.

To solve the above-mentioned problems, the fiber for reinforcing rubber products of the present invention, is fiber for reinforcing rubber products, which comprises fiber coated with a coating film formed by a coating agent, wherein the coating agent comprises, as calculated as solid contents, 100 parts by mass of a rubber latex containing at least a vinylpyridine/styrene/butadiene terpolymer, from 7 to 18 parts by mass of a latex of a halogen-containing polymer, and from 2 to 10 parts by mass of a water-soluble condensate of resorcinol and formaldehyde.

According to the fiber for reinforcing rubber products of the present invention, the treating agent for forming the coating film to cover the reinforcing fiber, contains the latex of a halogen-containing polymer in the above-mentioned specific proportion, whereby sufficient heat resistance can be obtained. In addition, such RFL treating agent contains the latex of a vinylpyridine/styrene/butadiene terpolymer in the above-mentioned specific proportion, whereby the tackiness of the reinforcing fiber is in a proper range, so that sufficient water resistance can be obtained, and there will be no trouble in the production. Thus, the fiber for reinforcing rubber products of the present invention is provided with both heat resistance and water resistance and is thus suitable for a timing belt for an automobile engine.

Further, in the fiber for reinforcing rubber products of the present invention, the above treating agent preferably contains from 10 to 14 parts by mass of the latex of a halogen-containing polymer per 100 parts by mass of the rubber latex containing at least a vinylpyridine/styrene/butadiene terpolymer. By adjusting the proportion within such a range, the balance between the water resistance and the heat resistance of the reinforcing fiber will be good.

Further, in the fiber for reinforcing rubber products of the present invention, the above treating agent preferably contains from 4 to 8 parts by mass of the water-soluble condensate of resorcinol and formaldehyde, per 100 parts by mass of the rubber latex containing at least a vinylpyridine/styrene/butadiene terpolymer. By adjusting the proportion within this range, the balance between the adhesion of the reinforcing fiber to the rubber base material constituting the rubber products, and the bending fatigue resistance of the finally obtainable timing belt, will be good.

Still further, in the fiber for reinforcing rubber products of the present invention, the above-mentioned latex of a halogen-containing polymer is preferably a latex of a chlorosulfonated polyethylene, whereby the heat resistance and the bending fatigue resistance of the finally obtainable timing belt can be made satisfactory.

In the accompanying drawing, FIG. 1 is a schematic view illustrating the structure of a water-pouring bending fatigue tester used in Examples.

Now, the present invention will be described in detail. In the following description "parts" means "parts by mass", and "%" means "% by mass", unless otherwise specified.

Firstly, the treating agent (hereinafter referred to as the first treating agent) comprising the rubber latex containing at least a vinylpyridine/styrene/butadiene terpolymer (hereinafter referred to also simply as the rubber latex), the latex of a halogen-containing polymer and the water-soluble condensate of resorcinol and formaldehyde, will be described.

As the vinylpyridine/styrene/butadiene terpolymer latex (hereinafter referred to also as the terpolymer latex) to be incorporated in the first treating agent, one which is commonly used for the treatment of fiber for reinforcing rubber products may be used. Among them, a latex obtained from a terpolymer wherein the proportions of vinylpyridine:styrene:butadiene are 10 to 20:10 to 20:60 to 80, is preferred. As such a terpolymer latex, Nipol-2518FS (tradename, manufactured by ZEON CORPORATION) or Pyratex (tradename, manufactured by NIPPON A&L INC.) may, for example, be suitably used.

Further, as the rubber latex of the present invention, the above-mentioned terpolymer latex may be used alone, or the terpolymer latex and a rubber latex other than the halogen-containing polymer latex (hereinafter referred to as "another rubber latex") may be used in combination. As such another rubber latex, a latex of a rubber having remaining double bonds (i.e. an unsaturated rubber) is preferably used, and for example, a latex of an acrylate type polymer, a latex of a styrene/butadiene copolymer, a latex of a carboxyl-modified styrene/butadiene copolymer, or a latex of a polybutadiene, may be mentioned.

Further, as the latex containing a halogen-containing polymer to be incorporated in the first treating agent, a latex obtained from a halogen-containing polymer, such as a chlorinated rubber, a chloroprene rubber or a chlorosulfonated polyethylene, may be mentioned. Among them, a latex of a chlorosulfonated polyethylene is preferred, since the heat resistance and the bending fatigue resistance of the finally obtainable timing belt can thereby be made satisfactory. As such a latex of a chlorosulfonated polyethylene, CSM450 (tradename, manufactured by SUMITOMO SEIKA CHEMICALS CO., LTD.) may, for example, be suitably used.

Further, as the water-soluble condensate of resorcinol and formaldehyde (hereinafter referred to also as "the RF condensate") to be incorporated in the first treating agent, it is possible to use a water-soluble addition condensate rich in oxymethyl groups, which is obtained by reacting resorcinol and formaldehyde in the presence of an alkaline catalyst such as an alkali metal hydroxide, ammonia or an amine. Particularly preferred is a RF condensate obtained by reacting resorcinol and formaldehyde in a molar ratio of 1:0.3 to 2.5.

To the first treating agent, the same additives as commonly used in conventional RFL treating agents, such as an anti-aging agent and a stabilizer, may be incorporated in addition to the rubber latex, the latex of a halogen-containing polymer and the RF condensate, as the case requires.

As the anti-aging agent, a liquid emulsified product of a mineral oil may, for example, be mentioned, and as the stabilizer, aqueous ammonia or an aqueous sodium hydroxide solution may, for example, be mentioned.

The first treating agent in the present invention can be obtained by uniformly mixing the components such as the rubber latex, the latex of a halogen-containing polymer, the RF condensate and the additives which are incorporated as the case requires, with water as a dispersant, in accordance with a usual method.

In such a first treating agent, it is necessary to incorporate the latex of a halogen-containing polymer in a proportion of from 7 to 18 parts, preferably from 10 to 14 parts, per 100 parts of the rubber latex, as calculated as solid contents.

If the proportion of the latex of a halogen-containing polymer is less than 7 parts, the heat resistance of the obtainable reinforcing fiber tends to be inadequate, and the durability at a high temperature of the finally obtainable timing belt tends to be poor. Further, the proportion of the rubber latex relatively increases, whereby tackiness of the obtained reinforcing fiber tends to be too high, whereby a trouble may be caused in its production.

On the other hand, if the proportion of the latex of a halogen-containing polymer exceeds 18 parts, the proportion of the rubber latex relatively decreases, whereby the tackiness of the reinforcing fiber thereby obtained, tends to be low, and the water resistance of the reinforcing fiber tends to be inadequate, and the durability against contact with water, of the finally obtainable timing belt, will be poor. In a case where the latex of a halogen-containing polymer is incorporated in a proportion of from 10 to 14 parts, the balance of the heat resistance and the water resistance of the reinforcing fiber will be excellent. Here, the proportions of the rubber latex and the latex of a halogen-containing polymer are proportions by mass of the respective solid contents.

Further, in a case where the terpolymer latex and another rubber latex are incorporated in the first treating agent, a part of the blend amount of the terpolymer latex is replaced by another latex so that the total of the terpolymer latex and another latex will be 100 parts. The proportions of the two are preferably such that, as solid contents, the terpolymer latex is from 70 to 95 parts, while another rubber latex is from 30 to 5 parts.

Further, in the first treating agent, the RF condensate is required to be incorporated in a proportion of from 2 to 10 parts, preferably from 4 to 8 parts, per 100 parts of the rubber latex, as calculated as solid contents. If the proportion of the RF condensate is less than 2 parts, the adhesion of the reinforcing fiber to the rubber base material constituting a rubber product such as a timing belt, tends to be inadequate, and if the proportion of the RF condensate exceeds 10 parts, the finally obtainable timing belt may sometimes be poor in the bending fatigue resistance. When the RF condensate is incorporated in a proportion of from 4 to 8 parts, the balance between the adhesion and the heat resistance of the reinforcing fiber and the bending fatigue resistance of the timing belt will be good.

Still further, the concentration of the first treating agent, i.e., the total content of components in the first treating agent including the rubber latex, the latex of a halogen-containing polymer, the RF condensate and additives which may be incorporated, as the case requires, is preferably from 10 to 50%, more preferably from 20 to 40%, as solid contents. If such a concentration is less than 10%, it may sometimes become difficult to impregnate the fiber with a sufficient amount of the first treating agent, and if it exceeds 50%, the stability of the first treating agent tends to be poor, and gelation may be likely to take place.

The fiber to be used in the present invention is not particularly limited, and it may be either inorganic fiber or organic fiber which is commonly used in a conventional rubber-reinforcing fiber. As the inorganic fiber, glass fiber or carbon fiber may be used, and as the organic fiber, aramid fiber, PBO (polyparaphenylenebenzoxazole) fiber, PET (polyethylene terephthalate) fiber, PEN (polyethylene naphthalate) fiber or polyketone fiber may, for example, be used. To such fibers, it is preferred to preliminarily apply a binding agent or a sizing agent, prior to being coated with the first treating agent, in order to improve the adhesive between the fiber itself and the coating film formed by the first treating agent.

Among the above fibers, it is preferred to use glass fiber in view of the wide applicability, the cost and easy application to the process for producing timing belts. As such glass fiber, one obtained by bundling from 200 to 600 glass monofilaments having a diameter of from 7 to 9 $\mu$m, may, for example, be employed. Further, the composition of the glass fiber is not particularly limited, and E glass or S glass may, for example, be mentioned. Further, in the case of glass fiber, it is preferably subjected to pretreatment with a binding agent containing e.g. a known silane coupling agent or coating film-forming agent.

The fiber for reinforcing rubber products of the present invention is one having the above-described fiber coated with a coating film (hereinafter referred to also as "the first coating film") formed by the above first treating agent. However, in order to further increase the adhesion with a rubber composition which will be the base material for a rubber product such as a tire or a rubber belt including a timing belt, it is preferred that the first coating film is further covered by a coating film (hereinafter referred to also as "the second coating film") formed by the following second treating agent.

As a first example of such a second treating agent (hereinafter referred to as the first example), a treating agent containing a rubber, a vulcanizer and an inorganic filler, may be mentioned. For example, it is possible to employ the treating agent disclosed in e.g. JP-A-63-126975 or JP-A-11-241275.

As the rubber to be incorporated in the above first example, a halogen-containing polymer or a hydrated nitrile rubber may be mentioned. As such a halogen-containing polymer, chlorinated rubber, chloroprene rubber, chlorinated polyethylene, chlorinated ethylene/propylene copolymer, chlorinated polyvinyl chloride or chlorosulfonated polyethylene may, for example, be used. Among them, it is particularly preferred to use chlorosulfonated polyethylene.

Further, as the vulcanizer, a polynitroso aromatic compound or a benzoquinone may, for example, be used. As the polynitroso aromatic compound, p-dinitrosobenzene or poly p-dinitrosobenzene may, for example, be mentioned. The benzoquinone may, for example, be tetrachlorobenzoquinone, p-, p'-dibenzoylbenzoquinone dioxime or p-benzoquinone dioxime. Among them, it is preferred to use poly p-dinitrosobenzene, tetrachlorobenzoquinone, p-, p'-dibenzoylbenzoquinone dioxime or p-benzoquinone dioxime.

As the inorganic filler, one commonly used as a filler for a rubber composition, such as silica or carbon black, may be used.

Further, in the above first example, an isocyanate or an additive may be incorporated, as the case requires, in addition to the above-described components.

As the isocyanate, methylenediphenyl isocyanate (MDI), toluene diisocyanate (TDI), triphenylmethane triisocyanate or naphthalene diisocyanate (NDI) may, for example, be used. An isocyanate monomer is highly volatile and is not preferred from the viewpoint of the safety and the handling efficiency, and it is preferred to use a polyisocyanate such as a dimer, which has a relatively small molecular weight and which is rich in reactivity. Such a polyisocyanate is preferably one having a polymerization degree of from 2 to 10. Further, as the additive, a softening agent, an anti-aging agent or a vulcanization accelerator may, for example, be mentioned.

The above first example can be obtained by dissolving the respective components by mixing the rubber, the vulcanizer, the inorganic filler, and the isocyanate and the additive which may be incorporated, as the case requires, with an organic solvent, by a usual method. As such an organic solvent, one commonly used in a conventional rubber cement may be employed. For example, xylene, toluene or methyl ethyl ketone may be mentioned.

In a case where an isocyanate is incorporated to the above first example, the proportion of the isocyanate to the rubber is preferably 100:10 to 100, by mass ratio. If the proportion of the isocyanate is larger than the above range, the heat resistance or the bending fatigue resistance, of the reinforcing fiber thereby obtainable tends to deteriorate, and if the proportion of the isocyanate is smaller than the above range, the adhesion of the obtained reinforcing fiber to the rubber composition may sometimes deteriorate.

Further, in the above first example, the proportion of the sum of the rubber and the isocyanate is preferably from 3 to 15%, more preferably from 5 to 10%, based on the entirety including the organic solvent. If the proportion of both is less than 3%, it sometimes tends to be difficult to coat the fiber with a sufficient amount of the second treating agent, and if it exceeds 15%, the viscosity of the second treating agent tends to be too high, and non-uniformity may sometimes result when it is coated on glass fiber.

Further, in the above first example, the proportion of the vulcanizer is preferably from 0.3 to 2%, more preferably from 0.6 to 1%, based on the entirety including the organic solvent. Likewise, the proportion of the inorganic filler is preferably from 0.5 to 5%, more preferably from 1 to 3%. If the proportion of the vulcanizer is less than 0.3%, the function as the vulcanizer tends to be inadequate, and peeling may sometimes be likely to take place between the first coating film and the second coating film of the reinforcing fiber thereby obtained, and if it exceeds 2%, peeling may sometimes be likely to take place between the reinforcing fiber and the base material rubber of the finally obtainable rubber product.

The above-described first example is to increase the adhesion between the reinforcing fiber and the rubber composition as the base material for a rubber product. However, in the timing belt to be used for an automobile engine, a rubber composition comprising as the main component a hydrogenated nitrile rubber (hereinafter referred to also as "H-NBR") having high heat resistance, is often used as the base material. In the above-described first example, the adhesion may sometimes be inadequate to a rubber composition comprising a highly saturated H-NBR as the main component wherein a peroxide is incorporated as a vulcanizer, which is employed as the base material to increase the heat resistance of a timing belt.

Accordingly, in a case where a rubber composition comprising highly saturated H-NBR as the main component, is used as the base material, the second treating agent is preferably made of a composition of the following second example (hereinafter referred to also as the second example), in order to make the adhesion with the rubber composition to be satisfactory.

As such a second example, a treating agent comprising an uncured phenol resin and a rubber, may be mentioned. The treating agent of such a second example may be obtained by mixing the uncured phenol resin and the rubber with a solvent in accordance with a usual method.

Such an uncured phenol resin to be used in the second example is one which is uncured among resins obtainable from a phenol and an aldehyde, i.e. one having a reactivity for curing. As such an uncured phenol resin, novolak and/or resol may preferably be mentioned. It is preferred to use novolak from the viewpoint such that the adhesion between H-NBR and the obtainable reinforcing fiber, can be increased, and it is preferred to use resol from such a viewpoint that the adhesion state at the interface between the first coating film and the second coating film can be made satisfactory. Further, in order to obtain both of such merits, it is preferred to use them in a ratio of novolak/resol being preferably from 10/4 to 10/1, as the solid contents.

As the rubber in the above second example, it is preferred to use rubber having a good affinity with the rubber composition, taking into consideration the compatibility with the rubber composition which will be the base material of a rubber product to be reinforced, such as a timing belt. As a preferred example, chloroprene rubber, chlorosufonated polyethylene, acrylonitrile/butadiene copolymer rubber (so-called "NBR"), or H-NBR may, for example, be mentioned. Among them, it is preferred to use an acrylonitrile/butadiene copolymer rubber in that the adhesion with H-NBR can be made satisfactory, and the flexibility of the second coating film formed by the second treating agent can be made satisfactory.

Further, in the second example, it is preferred to incorporate an uncured epoxy resin in addition to the above-mentioned uncured phenol resin and rubber, in that the adhesion between H-NBR and the obtained reinforcing fiber can be made satisfactory, and the good adhesion can be maintained even during heating.

Such an uncured epoxy resin is one which is not yet cured among epoxy resins, i.e. one having reactivity for curing. As such an epoxy resin, preferably, a bisphenol A type epoxy resin, a bisphenol F type epoxy resin, a phenol novolak type epoxy resin, or a cresol novolak type epoxy resin may, for example, be mentioned. Among them, a bisphenol A type epoxy resin is preferred, since the adhesion with H-NBR is particularly high.

The proportions of the uncured phenol resin and the rubber in the above second example, are such that the rubber is preferably from 10 to 60 parts, particularly preferably from 30 to 40 parts, per 100 parts of the uncured phenol resin. If the proportion of the rubber is less than 10 parts, the flexibility of the second coating film formed by the second treating agent may sometimes become poor. On the other hand, if it exceeds 60 parts, an adverse effect may sometimes be brought about to the adhesion between the fiber and the rubber composition as the base material for a rubber product.

Further, in a case where uncured epoxy resin is incorporated, the uncured epoxy resin is preferably from 2 to 20 parts, particularly preferably from 5 to 10 parts, per 100 parts of the uncured phenol resin. If the proportion of the epoxy resin is less than 2 parts, no adequate effect for improving the adhesion between the fiber and the rubber composition as the base material for a rubber product tends to be obtained. On the other hand, if it exceeds 20 parts, the flexibility of the second coating film formed by the second treating agent may sometimes become poor. Here, the above-mentioned proportions of the respective components are proportions as solid contents.

In the above second example, in addition to the above-described components, an inorganic filler or an additive may be incorporated, as the case requires. As such an inorganic filler, one which is common as a filler for a rubber composition, such as silica or carbon black, may be employed. As the additive, a softening agent, an anti-aging agent or a vulcanization accelerator which is common as an additive for a rubber composition, may be used.

Further, as a solvent to dissolve or disperse the above-mentioned respective components in the treating agent of the above second example, one or a combination of two or more may be used among those which are commonly used for conventional rubber cement, but it is preferred to use a solvent of a ketone type or an ester type. As a preferred example, methyl ethyl ketone (MEK), methyl isobutyl ketone (MIBK) or ethyl acetate, may, for example, be mentioned.

Further, the concentration of the above second example, i.e. the total content of components including the uncured phenol resin, the rubber, and the uncured epoxy resin, the inorganic filler or the additive, which may be incorporated as the case requires, is preferably from 3 to 20%, particularly preferably from 5 to 15%, as solid contents. If such a concentration is less than 3%, it may sometimes become difficult to coat the fiber with a sufficient amount of the second treating agent. On the other hand, if it exceeds 20%, the stability of the second treating agent may sometimes deteriorate.

The fiber for reinforcing rubber products of the present invention may be such that after coated with the second coating film like the above first example and the second example, the second coating film may further be coated with a third coating film formed by a third treating agent, as disclosed in JP-A-3-269177 or JP-A-7-190149.

Now, the process for producing the fiber for reinforcing rubber products of the present invention will be described.

Firstly, fiber to be coated is continuously immersed in a bath filled with the first treating agent to have the first treating agent deposited and impregnated on the fiber. Then, the fiber is continuously heated in e.g. a hot air oven of from 200 to 350° C. to dry and solidify the first treating agent to form a first coating film thereby to obtain coated fiber having the first coating film.

Here, the deposited amount of the first coating film to the coated fiber is preferably from 12 to 25%, more preferably from 16 to 22%, as solid content, based on the mass of the coated fiber. If the deposited amount is less than 12%, individual monofilaments of the coated fiber tend to be hardly adequately covered by the first coating film, and the monofilaments are likely to contact one another and tend to be abraded by friction, so that the resistant to fatigue from flexing of the finally obtainable timing belts, etc., tends to be poor, such being undesirable. On the other hand, if the deposited amount exceeds 25%, the flexibility of the coating film tends to be poor, and the bending fatigue resistance of the finally obtainable rubber belts, etc., likely tends to be low, such being undesirable.

Then, the above coated fibers are, individually or in combination of a plurality of them, subjected to primary twisting by a twisting machine such as a ring twisting machine to obtain a primary twisted yarn. The number of twists in this primary twisting step is preferably from 0.5 to 4 twists/25 mm. Otherwise, the coated fiber once taken up in a non-twisted state, may be subjected to primary twisting to obtain a primary twisted yarn, or a take-up apparatus in the above step of obtaining a coated fiber is modified to be a twisting machine, so that a step of obtaining a coated fiber and a primary twisting step may be carried out simultaneously to obtain a primary twisted yarn.

Then, from 5 to 20 primary twisted yarns are put together and subjected to second twisting by means of a twisting machine such as a ring twisting machine or a flier twisting machine to obtain a second twisted yarn, thereby to obtain the fiber for reinforcing rubber products of the present invention. The number of twists in this second twisting step is preferably from 0.5 to 4 twists/25 mm, and like in the conventional fiber for reinforcing rubber products, the twisting direction in the second twisting step is adjusted to be opposite to the twisting direction in the primary twisting step.

Further, in a case of covering by the second coating film formed by the second treating agent, in addition to the above step, treatment by the following step is applied to the second twisted yarn. Namely, the above-mentioned second twisted yarn is continuously immersed in a bath filled with the above-described second treating agent, or the second treating agent is sprayed or coated on the surface of the above-mentioned second twisted yarn to have the second treating agent applied to the second twisted yarn. Then, the second twisted yarn is continuously heated in e.g. a hot air oven of from 120 to 200° C. to dry and solidify the second treating agent to form a second coating film thereby to obtain the fiber for reinforcing rubber products of the present invention.

At that time, the deposited amount of the second coating film to the reinforcing fiber is preferably from 1 to 15%, particularly preferably from 3 to 10%, as solid content, based on the mass of the reinforcing fiber. If the deposited amount is less than 1%, the effect for increasing the adhesion between the reinforcing fiber and the rubber composition as the base material for rubber products is likely to be inadequate. Even if the deposited amount exceeds 15%, the effect for increasing the adhesion will not increase so much, and the adhesion may rather be hindered.

Now, the present invention will be described in further detail with reference to Examples. However, it should be understood that the present invention is by no means restricted to such specific Examples.

EXAMPLE 1

100 Parts of a terpolymer latex ("Pyratex", tradename, manufactured by NIPPON A&L INC.), 11.1 parts of a latex of a chlorosulfonated polyethylene ("CSM450", tradename, manufactured by SUMITOMO SEIKA CHEMICAL CO., LTD.), 6.7 parts of a RF condensate (solid content: 7%) and deionized water, were mixed to obtain a first treating agent having a concentration of 30%. Here, the above ratio of each component is a mass ratio as solid content.

200 Glass monofilaments made of high strength glass (S glass) and having a diameter of 7 $\mu$m, were bundled while applying a binding agent containing an amino silane coupling agent as the main component, followed by drying to obtain a glass fiber. Three such glass fibers drawn together were continuously immersed in a bath filled with the above-mentioned first treating agent to have the first treating agent deposited and impregnated on the glass fibers. Then, the glass fibers were continuously heated for one minute in a hot air oven at a temperature of 250° C. to dry and solidify the first treating agent, to obtain coated glass fibers having a first coating film. Here, the deposited amount of the first coating film was 18% as solid content based on the mass of the coated glass fibers.

Further, the above coated glass fibers were individually subjected to primary twisting by means of a ring twisting machine so that the number of twists became 2 twists/25 mm to obtain primary twisted yarns. Then, 11 such primary twisted yarns drawn together, were subjected to second twisting by means of a separate ring twisting machine in a twisting direction opposite to the primary twisting so that the number of twists became 2 twists/25 mm, to obtain a second twisted yarn.

Then, 10 parts of a chlorosulfonated polyethylene ("Hypalon 40" manufactured by DuPont Dow Elastomers L.L.C.) as a halogen-containing polymer, 5 parts of a polyisocyanate ("MR-200", tradename, manufactured by NIPPON POLYURETHANE K.K.), 2 parts of p,p'-dibenzoylbenzoquinone dioxime as a vulcanizer, 5 parts of carbon black as an inorganic filler, and toluene as an organic solvent, were mixed to obtain a second treating agent having a concentration of 10%.

The second twisted yarns obtained as described above, were continuously immersed in a bath filled with the above-mentioned second treating agent to have the second treating agent coated and deposited on the second twisted yarns. Then, the second twisted yarns were continuously heated for one minute in a hot air oven at a temperature of 130° C. to dry and solidify the second treating agent to form a second coating film thereby to obtain the fiber for reinforcing rubber products of the present invention. Here, the deposited amount of the second coating film was 3.5% as solid content based on the mass of the reinforcing fiber.

EXAMPLE 2

79.4 Parts of a terpolymer latex ("Pyratex", tradename, manufactured by NIPPON A&L INC.), 20.6 parts of a latex of a styrene/butadiene copolymer ("NIPOL2570X5", tradename, manufactured by ZEON CORPORATION), 11.1 parts of a latex of a chlorosulfonated polyethylene ("CSM450", tradename, manufactured by SUMITOMO SEIKA CHEMICAL CO., LTD.), 6.7 parts of a RF condensate (solid content: 7%) and deionized water, were mixed to obtain a first treating agent having a concentration of 30%. Here, the above ratio of each component is a mass ratio as solid content.

The fiber for reinforcing rubber products of the present invention was obtained by using the same glass fiber and second treating agent as used in Example 1 by the process under the same conditions as in Example 1 except that the above first treating agent was employed.

COMPARATIVE EXAMPLE 1

100 Parts of a terpolymer latex ("Pyratex", tradename, manufactured by NIPPON A&L INC.), 43.9 parts of a latex of a chlorosulfonated polyethylene ("CSM450", tradename, manufactured by SUMITOMO SEIKA CHEMICAL CO., LTD.), 8.4 parts of a RF condensate (solid content: 7%) and deionized water, were mixed to obtain a first treating agent having a concentration of 30%. Here, the above ratio of each component is a mass ratio as solid content.

The fiber for reinforcing rubber products was obtained by using the same glass fiber and the same second treating agent as used in Example 1 by the process under the same conditions as in Example 1, except that the above first treating agent was employed.

COMPARATIVE EXAMPLE 2

89 Parts of a terpolymer latex ("Pyratex", tradename, manufactured by NIPPON A&L INC.), 11 parts of a latex of a styrene/butadiene copolymer ("NIPOL2570X5", tradename, manufactured by ZEON CORPORATION), 5.3 parts of a latex of a chlorosulfonated polyethylene ("CSM450", tradename, manufactured by SUMITOMO SEIKA CHEMICAL CO., LTD.), 11.2 parts of a RF condensate (solid content: 7%) and deionized water, were mixed to obtain a first treating agent having a concentration of 30%. Here, the above ratio of each component is a mass ratio as solid content.

The fiber for reinforcing rubber products was obtained by using the same glass fiber and second treating agent as used in Example 1 by the process under the same conditions as in Example 1 except that the above first treating agent was employed.

TEST EXAMPLES

With respect to the respective fibers for reinforcing rubber products obtained in the above Examples 1 and 2 and Comparative Examples 1 and 2, the tensile strength and the diameter were measured. Further, evaluation of the adhesion and the bending fatigue resistance was carried out by the following methods, with respect to rubber products using the respective reinforcing fibers and a rubber composition having the following composition, as the base material. The results are shown in Table 1.

Method for Measuring the Tensile Strength

Using a tensile tester, the measurement was carried out under such conditions that the chuck distance was 250 mm, and the tensile speed was 250 mm/min.

Method for Measuring the Diameter of the Reinforcing Fiber

Using a constant pressure thickness measuring device, four reinforcing fibers arranged in parallel without space, were pressed under a pressure of 226 g/cm$^2$ for 5 seconds, and the thickness was measured in a state where the four fibers were so arranged, and the measured value was taken as the diameter.

Rubber Composition

Hydrogenated nitrile rubber (Zetpol 2000, tradename, manufactured by ZEON Corporation):100 parts, zinc oxide:10 parts, zinc methacrylate:15 parts, a zinc salt of 2-mercaptobenzimidazole:1 part, substituted diphenylamine:1 part, carbon black [HAF]:3 parts, silica hydrate:30 parts, dicumyl peroxide:10 parts, 1,3-bis(t-butylperoxyisopropyl)benzene:5 parts, sulfur:0.3 part, TMTD[tetramethylthiuram disulfide]:1 part, MBT[2-mercaptobenzothiazole]:0.5 part.

Method for Evaluating the Adhesion

On a rubber sheet having a thickness of 3 mm, a width of 25 mm and a length of 100 mm, obtained by processing the above-mentioned rubber composition, reinforcing fibers were arranged along the lengthwise direction without space. Then, the same rubber sheet as mentioned above, was placed, so that the reinforcing fibers were sandwiched between the upper and lower rubber sheets. This assembly was heated and pressed by means of a heat pressing apparatus at a temperature of 170° C. under a pressure of 42 kgf for 20 minutes, to obtain a test specimen.

With respect to this test specimen, peeling between the reinforcing fiber and the rubber sheet was carried out at a tensile speed of 50 mm/min by means of an autograph, whereby the adhesive strength between the reinforcing fiber and the rubber sheet was measured.

Retention of the Tensile Strength After the Water-Pouring Bending Fatigue Test Under Heating Using the respective fibers for reinforcing rubber products, and the above-mentioned rubber composition, flat belts each having a width of 9 mm, a thickness of 2 mm and a length of 400 mm, were prepared, respectively. Here, each flat belt has a structure wherein one reinforcing fiber is embedded at the center portion of a strip-shaped flat rubber plate, and the embedded reinforcing fiber extends from both ends of the flat rubber plate, respectively, and the flat rubber plate portion is the belt portion having the above size. With respect of such a flat belt, the heat resistance and the water resistance were evaluated by the following methods.

A test was carried out by means of a water-pouring bending fatigue tester having a structure shown in FIG. 1. In FIG. 1, three flat pulleys 21, 22 and 23 having a diameter of 30 mm are fixed to a reciprocating motion member 2 in a rotatable state, and this reciprocating motion member 2 is slidably mounted on a slide rail 3. The reciprocating motion member 2 is driven by a cylinder shaft 41 of an air cylinder 4, connected thereto, and reciprocates in the direction shown by the arrows in the Figure. Further, the slide rail 3 is fixed to stands 6 and 7, and the air cylinder 4 is also fixed to the stand 6. The stands 6 and 7 are fixed to a platform 8.

Firstly, a flat belt 5 was mounted on the above water-pouring bending fatigue tester 1, as shown in FIG. 1. Namely, a belt portion 51 of the flat belt 5 was put along the flat pulleys 21, 22 and 23, and one end of the reinforcing fiber 52 extending from the end of the flat belt 5 was put on pulleys 9 and 10 and then fixed to a bolt 12 fixed to the platform 8. The other end of the reinforcing fiber 52 is put on a pulley 11, and then connected to a weight 13 (mass: 11.5 kg) in order to give a tension to the flat belt 5.

And, while dropping tap water from above to the portion where the flat belt 5 and the flat pulley 2 were in contact, in an amount of 100 cc/hr by a supply device not shown, the reciprocating motion member 2 was moved in a one way moving distance of 180 mm, and along with the reciprocating motion, the portions where the flat belt 5 was in contact with the flat pulleys 21, 22 and 23, were moved to impart bending to the belt portion 51 thereby to subject the flat belt 5 to a water-pouring bending fatigue test. Further, to carry out evaluation of the heat resistance at the same time, the atmospheric temperature was maintained to be 120° C. by a constant temperature vessel not shown, which was installed to surround the circumferences of the reciprocating motion member 2, the flat pulleys 21, 22 and 23 and the flat belt 5.

The test was carried out in such a manner that by counting one reciprocation of the reciprocating motion member 2 as one time, the reciprocating motion member 2 was reciprocated 1,000,000 times at a speed of 60 times per minute, to let the flat belt 5 undergo bending fatigue. Then, the flat belt 5 was dismounted from the water-pouring bending fatigue tester 1, and the tensile strength was measured under a condition such that the tensile speed of the tensile testing machine was 250 mm/min.

The evaluation was made in such a manner that a value obtained by dividing the tensile strength value of the flat belt after the water-pouring bending fatigue test by the tensile strength value of the flat belt which was prepared under the same conditions by means of the same reinforcing fiber and not subjected to the water-pouring bending fatigue test, was represented by a percentage, which was taken as the tensile strength retention. This tensile strength retention was used as an index to evaluate the degree of deterioration in the tensile strength of the flat belt by the water-pouring bending fatigue test under heating.

TABLE 1

| | Ex. 1 | Ex. 2 | Comp. Ex. 1 | Comp. Ex. 2 |
|---|---|---|---|---|
| Tensile strength (N) | 1002 | 1033 | 1040 | 1018 |
| Fiber diameter (mm) | 0.85 | 0.87 | 0.88 | 0.85 |
| Adhesive strength (N/25 mm) | 126 | 126 | 125 | 125 |
| Tensile strength retention (%) | 80 | 79 | 71 | 69 |

As shown in Table 1, it is evident that as compared with the reinforcing fibers in Comparative Examples 1 and 2 wherein the proportion of the terpolymer latex or the chlorosulfonated polyethylene latex contained in the first treating agent is outside the scope of the present invention, the fibers for reinforcing rubber products of the present invention (Examples 1 and 2) are equal in tensile strength and adhesive strength, but have high tensile strength retention after the water-pouring bending fatigue test under heating, and thus are superior in both the heat resistance and the water resistance.

Further, in Example 1 employing the first treating agent which contains a relatively large amount of the terpolymer latex, the fiber diameter is small. This may be explained that due to a proper degree of tackiness, adhesion of the primary twisted yarns constituting the reinforcing fiber one another became high, whereby the fiber was tightened.

As described in the foregoing, the fiber for reinforcing rubber products of the present invention has excellent heat resistance and water resistance at the same time, whereby the durability at high temperatures or the durability in contact with water can be substantially improved for a rubber product such as a timing belt which employs this fiber as a reinforcing material.

The entire disclosure of Japanese Patent Application No. 2003-173085 filed on Jun. 18, 2003 including specification, claims, drawings and summary is incorporated herein by reference in its entirety.

What is claimed is:

1. Fiber for reinforcing rubber products, which comprises fiber coated with a coating film formed by a coating agent, wherein the coating agent comprises, as calculated as solid contents, 100 parts by mass of a rubber latex containing at least a vinylpyridine/styrene/butadiene terpolymer, from 7 to 18 parts by mass of a latex of a halogen-containing polymer, and from 2 to 10 parts by mass of a water-soluble condensate of resorcinol and formaldehyde.

2. The fiber for reinforcing rubber products according to claim 1, wherein the coating agent contains from 10 to 14 parts by mass of the latex of a halogen-containing polymer per 100 parts by mass of the rubber latex containing at least a vinylpyridine/styrene/butadiene terpolymer.

3. The fiber for reinforcing rubber products according to claim 1, wherein the coating agent contains from 4 to 8 parts by mass of the water-soluble condensate of resorcinol and formaldehyde per 100 parts by mass of the rubber latex containing at least a vinylpyridine/styrene/butadiene terpolymer.

4. The fiber for reinforcing rubber products according to claim 1, wherein the latex of a halogen-containing polymer is a latex of a chlorosulfonated polyethylene.

* * * * *